US011603236B2

(12) United States Patent
Barber

(10) Patent No.: US 11,603,236 B2
(45) Date of Patent: Mar. 14, 2023

(54) BABY FOOD FEEDER

(71) Applicant: Kelly Barber, Glen Mills, PA (US)

(72) Inventor: Kelly Barber, Glen Mills, PA (US)

( * ) Notice: Subject to any disclaimer, the term of this patent is extended or adjusted under 35 U.S.C. 154(b) by 376 days.

(21) Appl. No.: 14/978,161

(22) Filed: Dec. 22, 2015

(65) Prior Publication Data

US 2017/0172853 A1 Jun. 22, 2017

(51) Int. Cl.

| | |
|---|---|
| ***B65D 47/06*** | (2006.01) |
| ***A47G 19/22*** | (2006.01) |
| ***A47G 19/02*** | (2006.01) |

(52) U.S. Cl.

CPC ..... *B65D 47/06* (2013.01); *A47G 19/02* (2013.01); *A47G 19/2266* (2013.01)

(58) Field of Classification Search

CPC ..... A47G 19/02; A47G 19/2266
USPC ..... 220/705, 707, 709; 215/229, 388, 389
See application file for complete search history.

(56) References Cited

U.S. PATENT DOCUMENTS

| | | | | |
|---|---|---|---|---|
| 2,948,453 | A * | 8/1960 | Drown | B65D 47/283 215/388 |
| 3,106,312 | A * | 10/1963 | Hitchcock | A47G 19/2266 220/709 |
| 4,428,498 | A * | 1/1984 | Obey | B65D 47/103 206/508 |
| 4,494,668 | A * | 1/1985 | Lottick | A47G 19/2266 215/229 |
| 2002/0148845 | A1 | 10/2002 | Zettle et al. | |
| 2003/0102318 | A1 * | 6/2003 | Lee | B65D 47/066 220/705 |
| 2015/0021321 | A1 | 1/2015 | Gosen et al. | |

* cited by examiner

*Primary Examiner* — Jeffrey R Allen
(74) *Attorney, Agent, or Firm* — Barley Snyder

(57) ABSTRACT

A baby food feeder is disclosed. The baby food feeder includes a lid and a food feeding tube. The lid includes a top panel and a tube receiving passageway disposed along and extending through the top panel. The food feeding tube extends through the tube receiving passageway and includes a support connector to the lid.

29 Claims, 5 Drawing Sheets

FIG. 7
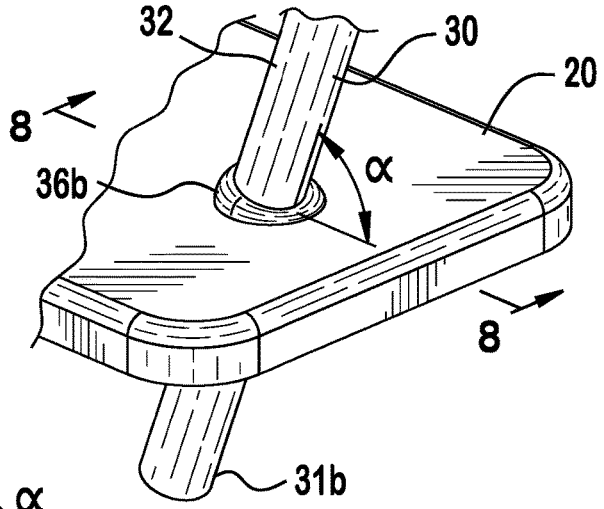
FIG. 8
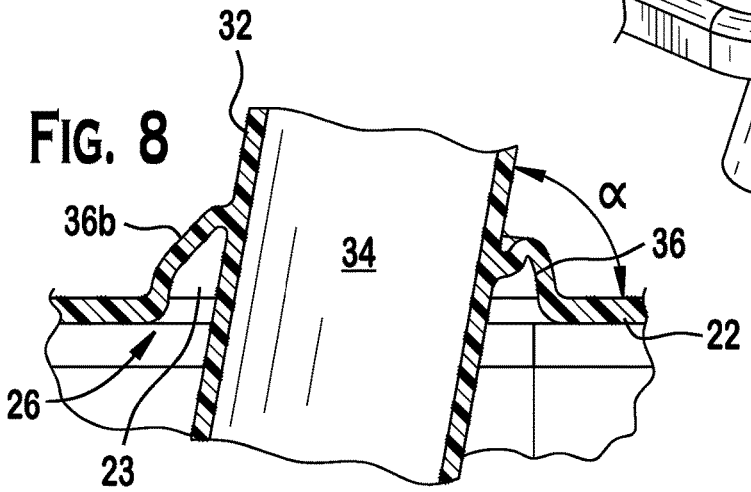
FIG. 9
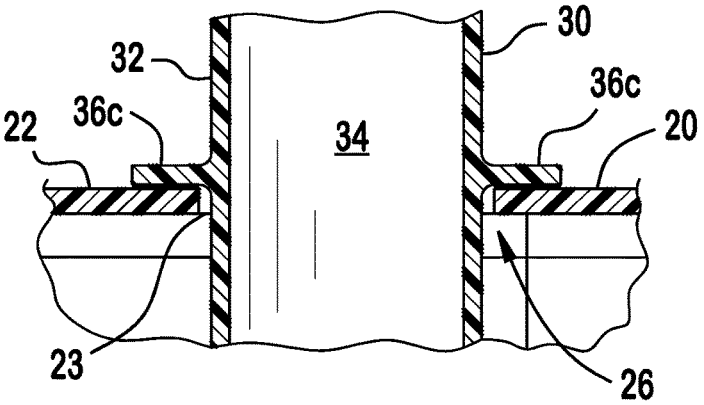
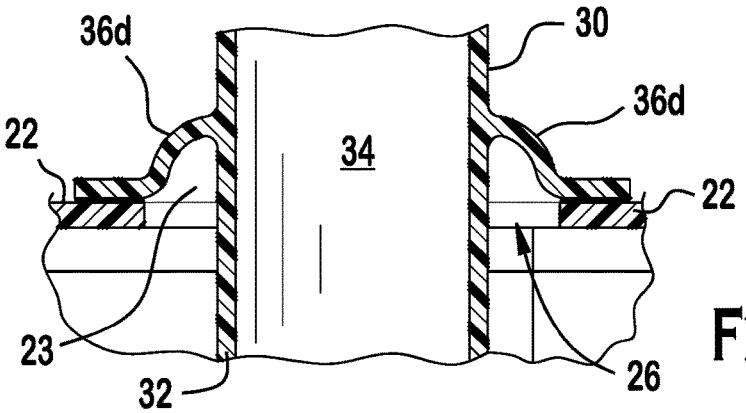
FIG. 10

BABY FOOD FEEDER

FIELD OF THE INVENTION

The invention relates to a food feeder and, more particularly, to a baby food feeder.

BACKGROUND

Typically, baby food, such as pureed fruits, vegetables, and meats, is stored in glass or plastic containers. These containers generally include a removable lid and the contents are transferred into another container, such as a bowl, before consumption by the baby. For convenience, many users use a utensil to remove the food and feed the baby.

More recently, food pouches have been used for convenience. These known food pouches include a hard nozzle with a cap that creates a liquid and airtight seal of the pouch. The nozzle is sized to fit within a baby's mouth, so that the baby can suck or squeeze the food out of the pouch without need for any other utensils.

While these known baby food pouches provide flexibility and mobility, many major baby food manufacturers do not offer food pouches for consumption. Furthermore, these food pouches are not reusable or adapted to use with known glass or plastic containers.

SUMMARY

In view of the aforementioned shortcomings, an object of the invention, among others, is to provide a baby food feeder having a lid and a food feeding tube. The baby food feeder includes a lid and a food feeding tube. The lid includes a top panel and a tube receiving passageway disposed along and extending through the top panel. The food feeding tube extends through the tube receiving passageway and includes a support connector to the lid.

BRIEF DESCRIPTION OF THE DRAWINGS

The invention will now be described by way of example with reference to the accompanying Figures, of which:

FIG. 7 is a perspective view of another baby food feeder according to the invention;

FIG. 8 is a sectional view of the baby food feeder of FIG. 7 taken along line 8-8;

FIG. 9 is a sectional view of another baby food feeder according to the invention; and FIG. 10 is a sectional view of another baby food feeder according to the invention.

DETAILED DESCRIPTION OF THE EMBODIMENT(S)

The invention is explained in greater detail below with reference to embodiments of a baby food feeder. This invention may, however, be embodied in many different forms and should not be construed as limited to the embodiments set forth herein; rather, these embodiments are provided so that this disclosure will be thorough and complete and still fully covey the scope of the invention to those skilled in the art.

Figure 1:
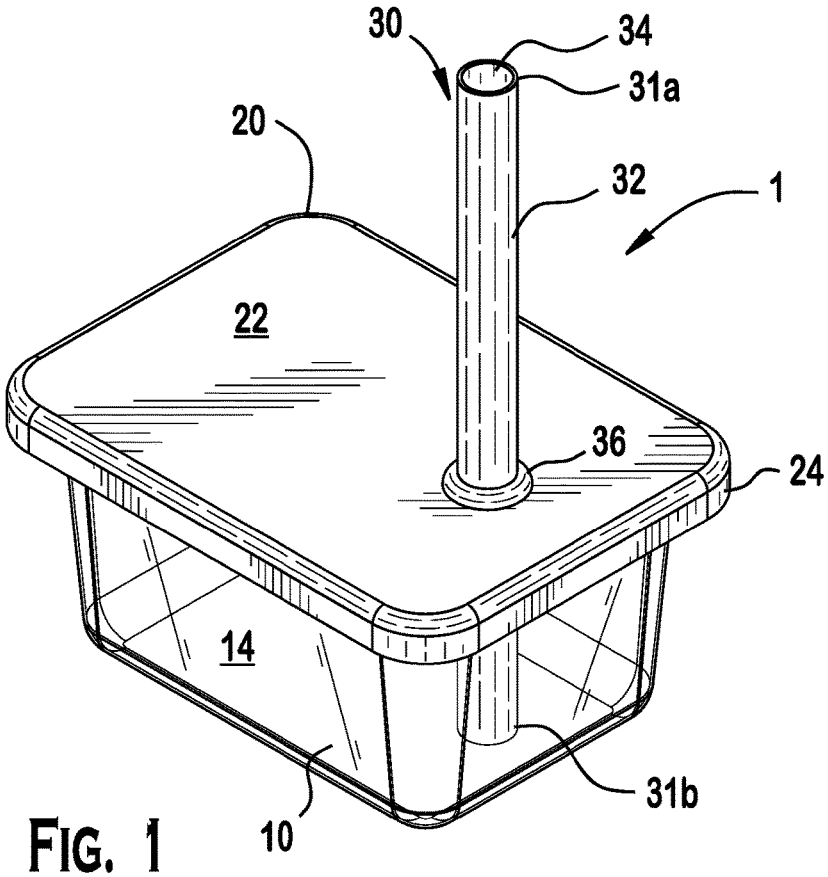
FIG. 1 is a perspective view of a baby food feeder according to the invention connected to a known storage container.

A baby food feeder 1 according to the invention is shown in FIG. 1. The baby food feeder 1 includes a lid 20, a food feeding tube 30, and a storage container 10. The major components of the invention will now be described in greater detail.

The lid 20 will be described with reference to FIGS. 1 and 3-6. As shown, the lid 20 generally includes a top panel 22, a tube receiving passageway 23, a sidewall 24, and a container receiving cavity 26. The lid 20 may be integrally formed or assembled from a set of pieces. The lid 20 may be a material such as plastic, but one skilled in the art would appreciate that other materials are possible.

Figure 5:
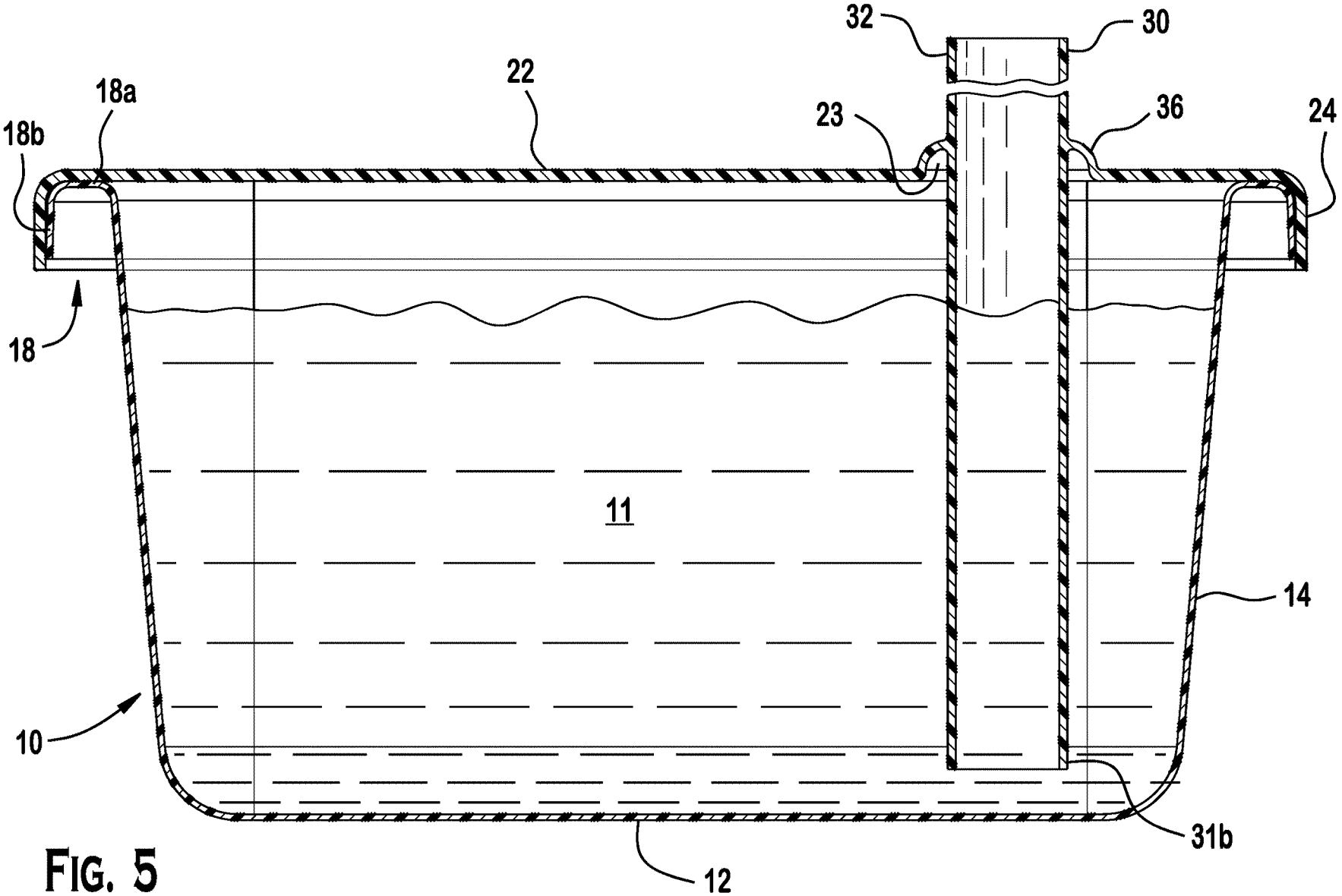
FIG. 5 is a sectional view of the baby food feeder of FIG. 1 taken along line 5-5 of FIG. 4.

The top panel 22, as shown in FIG. 5, is a planar surface. In the embodiment, the top panel 22 is rectangular shaped; however, one skilled in the art would appreciate that the top panel 22 could be any shape that permits the connections described below.

Figure 4:
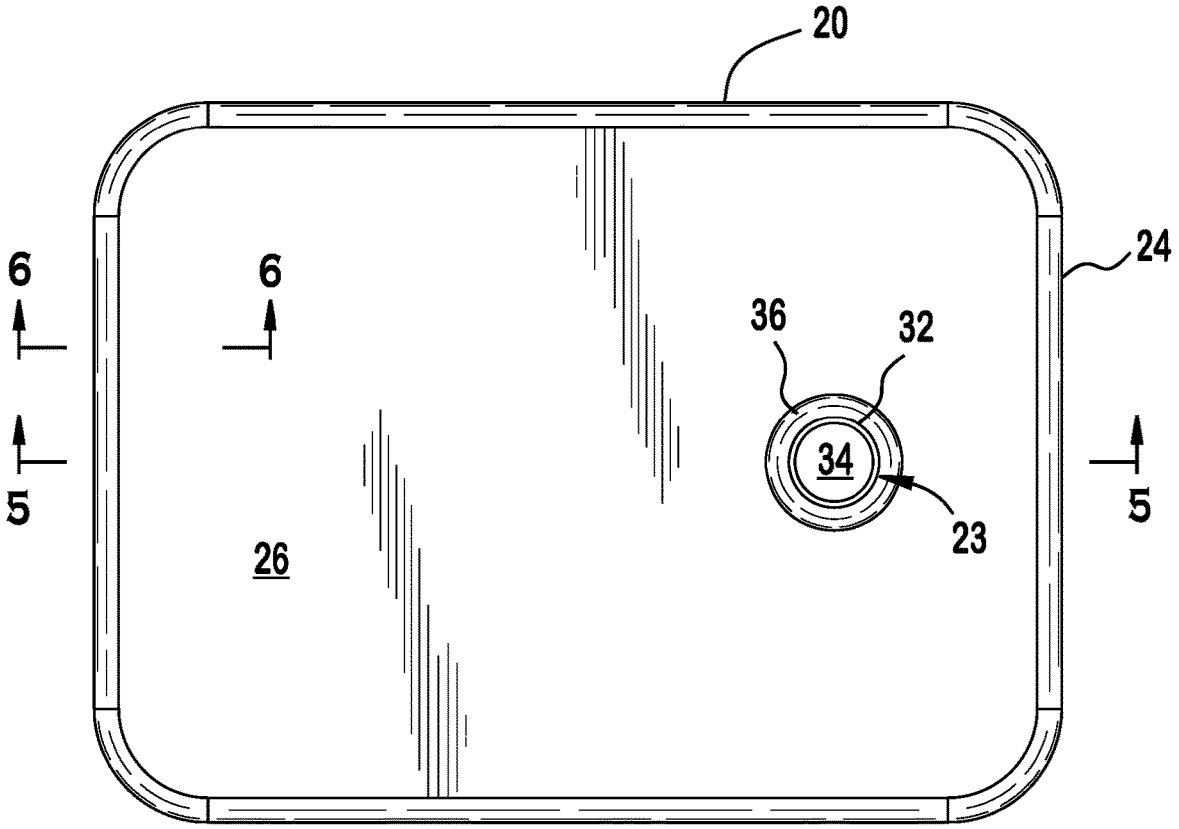
FIG. 4 is a top view of a lid of the baby food feeder of FIG. 1.

As shown in FIGS. 1, 4, and 5, the lid 20 further includes a tube receiving passageway 23 which defines a hole extending through the top panel 22 in the shown embodiment. The tube receiving passageway 23 may be a range of possible diameters for various embodiments, as one skilled in the art would appreciate.

Figure 3:
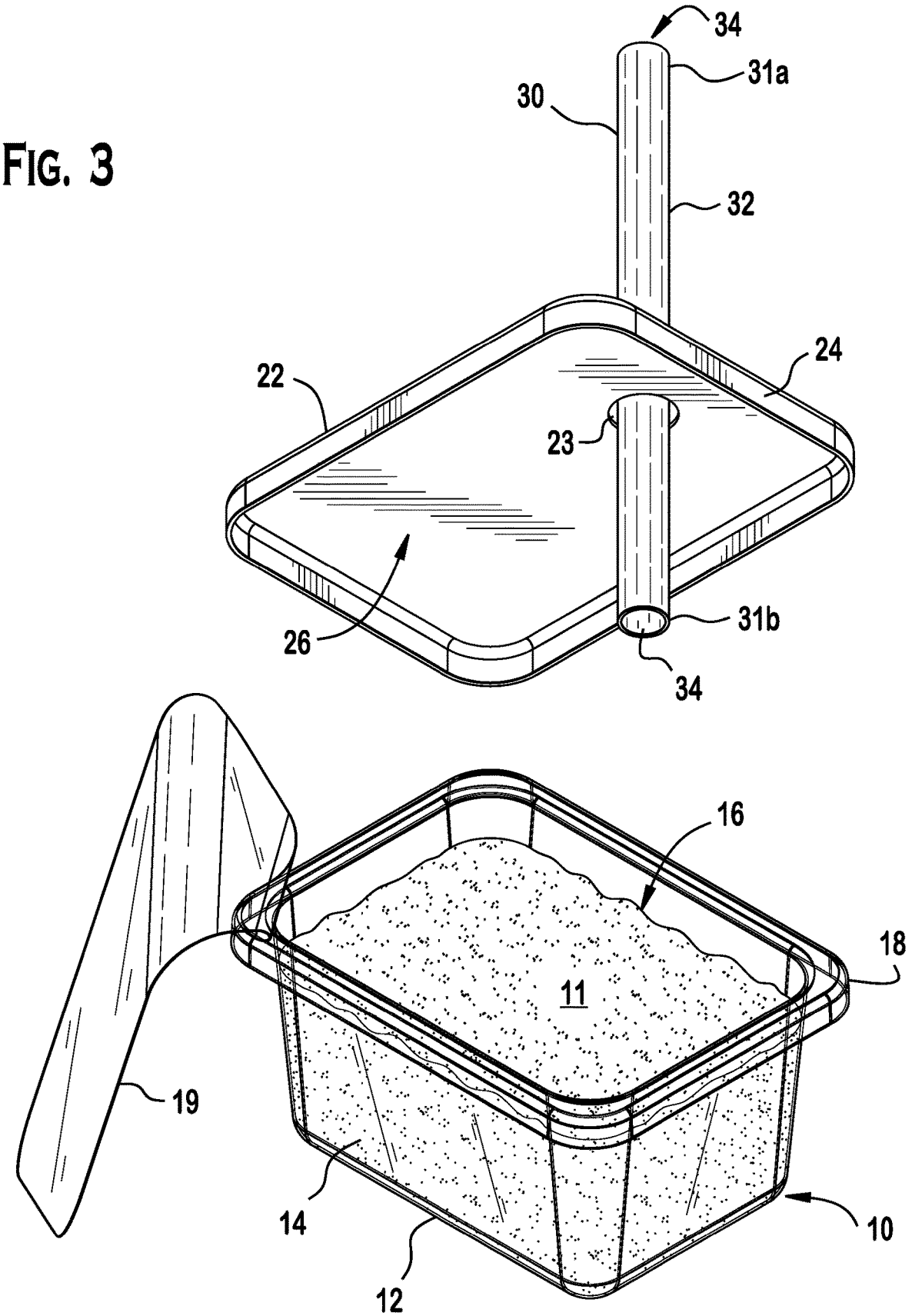
FIG. 3 is a perspective view of a baby food feeder of FIG. 1 positioned above the known storage container.

The sidewall 24 is a continuous wall element extending downward around the circumference of the top panel 22. The sidewall 24 defines the mouth of the container receiving cavity 26, as best shown in FIG. 3. In the embodiment, the sidewall 24 is substantially L-shaped in cross section and includes a downward flange 24*a*, best shown in FIG. 6, which extends downward from the top panel 22. A catch 24*b* is positioned along a distal end of the downward flange 24*a* that is opposite the top panel 22. In the shown embodiment, the catch 24*b* is a protrusion extending inward from the downward flange 24*a* and toward the container receiving cavity 26. However, the design is not limited to this. For instance, the catch 24*b* could be a planar wall, hook shaped member or other locking mechanism known to the art.

Now with reference to FIG. 1, the food feeding tube 30 will be described. The food feeding tube 30 generally includes a proximal end 31*a*, a distal end 31*b*, an outer wall 32, a food receiving passageway 34, a support connector 36, and a valve (not shown). The food feeding tube 30 may be integrally formed or assembled from a set of pieces. The food feeding tube 30 may be a rigid material, such as plastic, but one skilled in the art would appreciate that other materials are possible. Additionally, the food feeding tube 30 may be a resilient material, as will be described later.

As shown, the outer wall 32 is an elongated tubular element extending between the proximal end 31*a* and the distal end 31*b*. The outer wall 32 provides the food receiving passageway 34 therein. In the embodiment, the outer wall 32 is a cylindrical shaped, however, one skilled in the art would appreciate that the outer wall 32 could be any shape that permits the connections described below.

The support connector 36 is disposed around the circumference of the outer wall 32 and extends away from the outer wall 32. The support connector 36 is positioned between the proximal end 31*a* and distal end 31*b*.

The support connector 36 may be formed in a variety of shapes, as shown in FIGS. 5 and 7-10. As shown in FIG. 5, the support connector 36*a* is an arched element that is symmetrical on both sides of the outer wall 32. The support connector 36 may also be a curved symmetrical element including a flange as in support connector 36*d,* shown in FIG. 10, a flat symmetrical flange as in support connector 36*c,* shown in FIG. 9, or an asymmetrical curved element as in support connector 36*b,* shown in FIGS. 7 and 8. Other possible embodiments of the support connector 36, featuring other combinations of symmetry and shapes, would be appreciated by those skilled in the art.

The valve (not shown) may be disposed on the inside of the outer wall 32 within the food receiving passageway 34. The valve may be formed from a plurality of pieces abutting one another. One skilled in the art would appreciate that the number and shape of pieces may vary, or the form of the valve may vary, provided the valve seals the food receiving passageway 34.

Now with reference to FIGS. 3 and 5, the storage container 10 will be described.

The storage container 10 generally includes food 11, a container bottom 12, a container wall 14, a container cavity 16, a container rim 18, and a sheet 19. The storage container 10 is rigid, and may be integrally formed from a material such as plastic or glass, but one with skill in the art would appreciate that other materials are possible. The storage container 10 may alternatively be assembled from a set of pieces. The storage container 10 may be a baby food container known in the art, such as glass jars or plastic tubs produced by Gerber®, or food containers produced by other manufacturers in a variety of other forms.

The container bottom 12 is a planar surface. In the embodiment, the container bottom 12 is a rectangular shaped, however, one skilled in the art would appreciate that the container bottom 12 could be any shape that permits the connections described below.

A continuous container wall 14 extends up from the circumference of the container bottom 12 to define a food receiving cavity 16. As shown, food 11 is optionally contained within the food receiving cavity 16.

Figure 6:
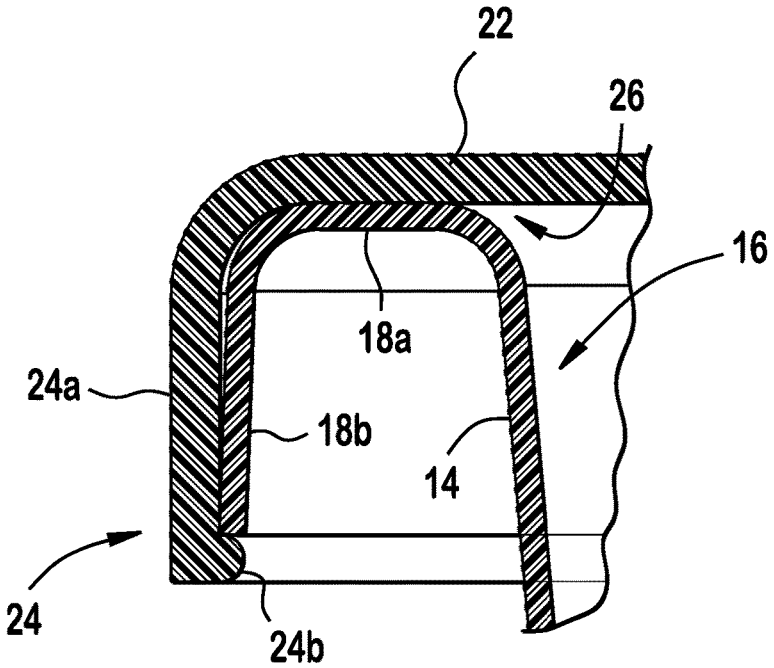
FIG. 6 is a close-up sectional view of a portion of the baby food feeder of FIG. 1 taken along line 6-6 of FIG. 4.

The top of the container wall 14 terminates in a substantially continuous container rim 18. The container rim 18 defines the mouth of the container cavity 16. In the embodiment, the container rim 18 is a rectangular shape matching the shape of the container bottom 12; however, one skilled in the art would appreciate that the container rim 18 could be any shape that permits the connections described below. As shown in FIG. 6, the container rim 18 is substantially L-shaped in cross section and includes an annular flange 18*a,* which extends outwardly from the container wall 14 in a direction away from the food receiving cavity 16, and a skirt 18*b,* which extends downwardly from the annular flange 18*a*.

The sheet 19 optionally covers the container cavity 16 by contacting the circumference of the container rim 18. The sheet 19 is removably attached to the container rim 18, such as by an adhesive material or other attachments known to those with skill in the art. In the embodiment, the sheet 19 is a flexible plastic material, however, one skilled in the art would appreciate that other materials are possible.

Now reference to the Figures, assembly of the baby food feeder 1 will now be described.

To form the baby food feeder 1, the lid 20 and food feeding tube 30 are connected at the support connector 36.

Figure 2:
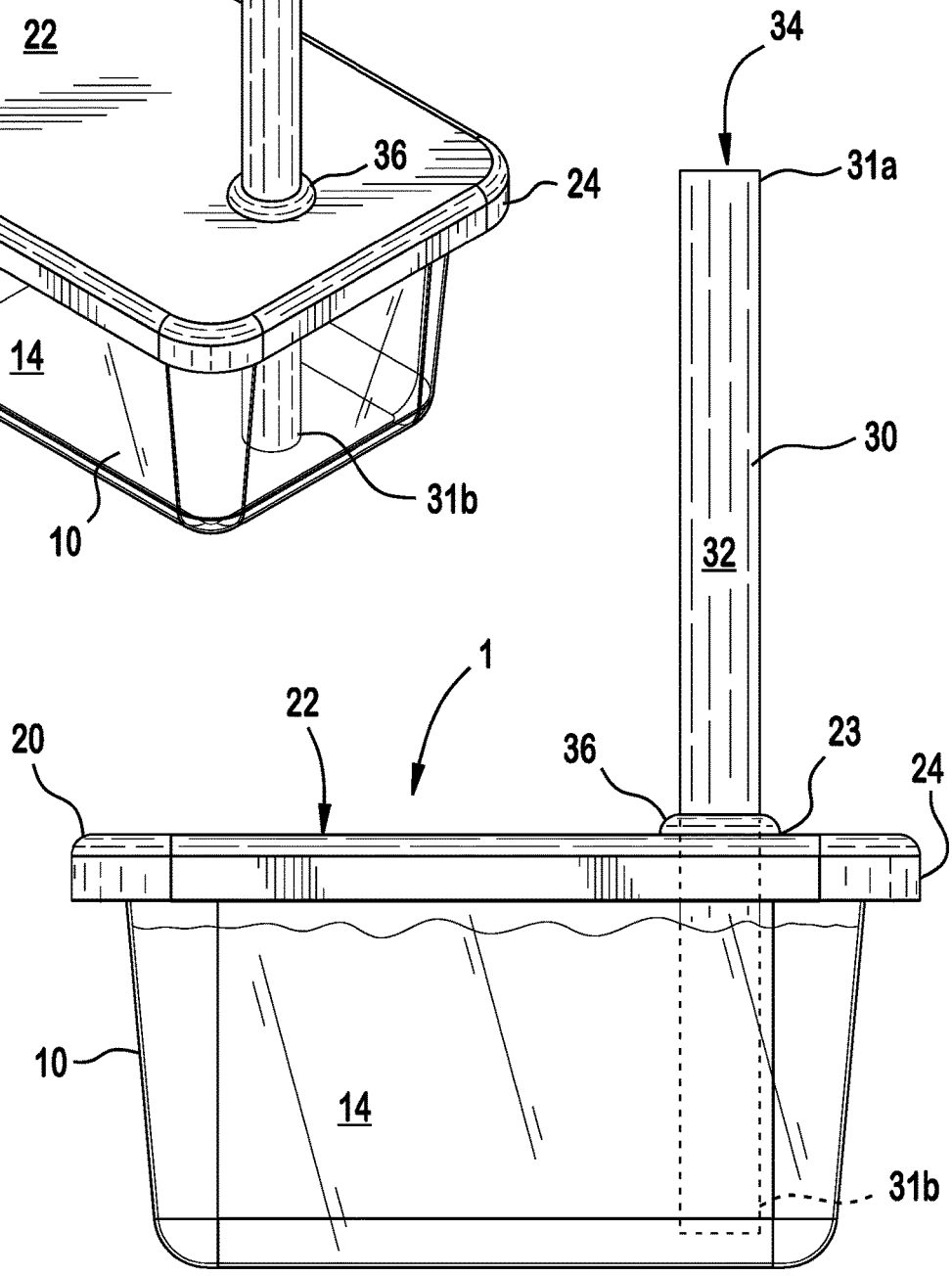
FIG. 2 is a front view of the baby food feeder of FIG. 1.

In an embodiment of the baby food feeder 1 shown in FIGS. 1, 2, and 5, the food feeding tube 30 may be integrally formed with the lid 20. As best shown in FIG. 5, in this embodiment the support connector 36*a* connects the food feeding tube 30 to the top panel 22 of the lid 20. In this embodiment, the support connector 36*a* is formed such that the food feeding tube 30 extends orthogonally with respect to the top panel 22.

In another embodiment, as shown in in FIGS. 7 and 8, the support connector 36*b* is integrally formed with the food feeding tube 30 and the lid 20, and connects the food feeding tube 30 to the top panel 22 of the lid 20. In this embodiment, the support connector 36*b* is shaped such that the food feeding tube 30 extends at an acute angle $\alpha$ with respect to a top surface of the top panel 22. The angle $\alpha$ of the embodiment may be between 45° and 70°, and is optionally 60°.

In another embodiment of the invention, as shown in FIGS. 9 and 10, the food feeding tube 30 is not integrally formed with the top panel 22 of the lid 20. The support connectors 36*c,* 36*d* in this embodiment extend at a length required to cover the tube receiving passageway 23. The bottom surface of the support connector 36*c,* 36*d* abuts the top surface of the top panel 22 such that the food feeding tube 30 extends orthogonally with respect to the top panel 22.

The storage container 10 contains baby food 11 and may be enclosed by the sheet 19.

Now with reference to the Figures, use of the baby food feeder 1 according to the embodiments of the invention will be described.

Firstly, a user first peels the sheet 19 off of the container rim 18, as shown in FIG. 3.

In the embodiments described above in which the food feeding tube 30 is integrally formed with the lid 20, a user positions the inside surface of the sidewall 24 around the outside surface of the container rim 18 of the storage container 10. The user presses down on the lid 20 until the top panel 22 abuts the annular flange 18*a,* as shown in FIG. 6. In this position, the downward flange 24*a* also abuts the skirt 18*b* and the optional catch 24*b* extends below the bottom of the skirt 18*b,* securing the integrally formed lid 20 and food feeding tube 30 to the container 10.

In the assembled baby food feeder 1 of these embodiments, the food feeding tube 30 is positioned orthogonally or at an angle with respect to the top panel 22, as described above and shown in FIGS. 2 and 7, and extends into the container cavity 16. The support connector 36*a,* 36*b* is positioned between the proximal end 31*a* and distal end 31*b* of the food feeding tube 30 such that, when the baby food feeder 1 is used with the storage container 10, the distal end 31*b* extends into the container cavity 16 but does not contact the container bottom 12.

In the embodiments described above in which the food feeding tube 30 is not integrally formed with the lid 20, a user positions the inside surface of the sidewall 24 around the outside surface of the container rim 18 of the storage container 10. The user presses down on the lid 20 until the top panel 22 abuts the annular flange 18*a,* as shown in FIG. 6. In this position, the downward flange 24*a* also abuts the skirt 18*b* and the optional catch 24*b* extends below the bottom of the skirt 18*b,* securing the lid 20 to the container 10.

The user then inserts the food feeding tube 30 into the tube receiving passageway 23. The food feeding tube 30 of this embodiment includes the support connector 36*c,* 36*d* which is positioned between the proximal end 31*a* and distal end 31*b* of the food feeding tube 30 such that, when the baby food feeder 1 is used with the storage container 10, the distal end 31*b* extends into the container cavity 16 but does not contact the container bottom 12.

The positioning of the food feeding tube 30 in the assembled baby food feeder 1 according to the above embodiments permits a baby to extract the baby food 11 through the food receiving passageway 34. The optional valve is actuated by the baby; permitting food 11 to flow through the food receiving passageway 34 when the baby uses the baby food feeder 1, and preventing the food 11 from flowing outside of the container cavity 16 and food receiving passageway 34 when the baby food feeder 1 is not in use.

While the invention has been described in detail and with reference to specific embodiments, one of ordinary skill in the art would appreciate that the described embodiments are illustrative, and that various changes and modifications can be made without departing from the scope of the invention.

What is claimed is:

1. A baby food feeder, comprising:

a storage container with a container bottom, a container wall secured to the container bottom and providing a food container cavity, and a container rim extending about the container wall;

a lid having:

a top panel removably secured to the container wall;

a tube receiving passageway disposed along and extending through the top panel; and a food feeding tube extending through the tube receiving passageway and having:

a distal end of the food feeding tube within the food container cavity;

an elongated rigid outer wall providing a food receiving passageway; and a resilient support connector permanently secured to the top panel and having a first end permanently secured about an entire circumference of the outer wall and a second end secured to and extending upward from an outer surface of the top panel, such that the distal end of the food feeding tube can be laterally traversed within the food container cavity by pivoting of the food feeding tube within the resilient support connector, while the top panel is in a position secured to the container wall.

2. The baby food feeder according to claim 1, wherein the support connector abuts the top panel.

3. The baby food feeder according to claim 2, wherein the food feeding tube extends at an orthogonal angle with respect to the lid.

4. The baby food feeder according to claim 2, wherein the support connector is a flat flange.

5. The baby food feeder according to claim 2, wherein the support connector is curved and includes a flange.

6. The baby food feeder according to claim 1, wherein the food feeding tube and support connector are integrally formed with the lid.

7. The baby food feeder according to claim 6, wherein the support connector is curved.

8. The baby food feeder according to claim 6, wherein the food feeding tube extends at an orthogonal angle with respect to the lid.

9. The baby food feeder according to claim 6, wherein the food feeding tube extends at an acute angle with respect to the lid.

10. The baby food feeder according to claim 9, wherein the food feeding tube extends at an angle between 45° and 70° with respect to the lid.

11. The baby food feeder according to claim 9, wherein the food feeding tube extends at an angle of 60° with respect to the lid.

12. The baby food feeder according to claim 1, wherein the lid includes a sidewall having a downward flange extending downward from the top panel and defining a container receiving cavity.

13. The baby food feeder according to claim 12, wherein the downward flange extends around a circumference of the top panel.

14. The baby food feeder according to claim 13, wherein the sidewall includes a catch.

15. The baby food feeder according to claim 14, wherein the catch is disposed at an end of the downward flange opposite the top panel.

16. The baby food feeder according to claim 15, wherein the catch is a protrusion.

17. The baby food feeder according to claim 16, wherein the protrusion extends inward from the downward flange in the direction of the container receiving cavity.

18. The baby food feeder according to claim 15, wherein the catch is a planar wall.

19. The baby food feeder according to claim 15, wherein the catch is a hook shaped member.

20. The baby food feeder according to claim 15, wherein the catch is a locking mechanism.

21. A baby food feeder system, comprising:

a rigid container having a bottom and a container wall defining a container cavity;

a lid having:

a top panel removably secured to the storage container;

a tube receiving passageway disposed along and extending through the top panel and into the food container cavity;

a sidewall having a downward flange extending downward from the top panel and defining a container receiving cavity; and a food feeding tube extending through the tube receiving passageway and into the food container cavity, the food feeding tube having a flexible support connector permanently secured to the lid and extending about and permanently secured to a circumference of the food feeding tube, such that a distal end of the food feeding tube can be laterally traversed within the food container cavity by pivoting of the food feeding tube within the flexible support connector while the top panel is in a position secured to the container wall.

22. The baby food feeder system according to claim 21, wherein the sidewall includes a catch.

23. The baby food feeder system according to claim 22, wherein the rigid container further includes a rim having an annular flange extending around the circumference of the top of the container wall.

24. The baby food feeder system according to claim 23, wherein the lid is removably attached to the container.

25. The baby food feeder system according to claim 23, wherein the rim further includes a skirt extending downward from the annular flange.

26. The baby food feeder system according to claim 25, wherein the annular flange abuts the top panel of the lid, and the skirt abuts the downward flange of the lid.

27. The baby food feeder system according to claim 26, wherein the catch extends below an end of the skirt opposite the annular flange.

28. The baby food feeder system according to claim 21, wherein the food feeding tube extends into the container cavity.

29. The baby food feeder system according to claim 28, wherein the support connector is positioned on the food feeding tube such that the food feeding tube does not contact the bottom of the container.

* * * * *